US005602088A

United States Patent [19]

Tokosh et al.

[11] Patent Number: 5,602,088

[45] Date of Patent: Feb. 11, 1997

[54] FLOATING SOAP AND METHOD

[75] Inventors: Richard Tokosh, Saddle Brook, N.J.; Linda Dunseath; Joseph Stephenson, both of Cincinnati, Ohio

[73] Assignee: Avon Products, Inc., Suffern, N.Y.

[21] Appl. No.: 487,958

[22] Filed: Jun. 7, 1995

[51] Int. Cl.[6] ..... C11D 17/04; C11D 11/00; C11D 17/02

[52] U.S. Cl. ..... 510/144; 510/145; 510/152; 510/153; 446/153

[58] Field of Search ..... 510/145, 141, 510/152, 153, 144

[56] References Cited

U.S. PATENT DOCUMENTS

| | | | |
|---|---|---|---|
| 196,766 | 11/1877 | Quentin | 510/144 |
| 883,360 | 3/1908 | Stohr | 510/145 |
| 2,195,399 | 4/1940 | Eagen | 510/145 |
| 2,403,925 | 7/1946 | Ittner | 510/145 |
| 2,494,891 | 1/1952 | Marshall | 510/145 |
| 2,525,081 | 8/1949 | Schulerud | 510/145 |
| 3,403,106 | 9/1968 | Story et al. | 510/144 |
| 3,413,230 | 11/1968 | Dupuis | 510/144 |
| 3,969,256 | 3/1976 | Hadley | 510/144 |
| 4,606,839 | 8/1986 | Harding | 510/145 |
| 5,194,172 | 3/1993 | Taneri et al. | 510/145 |
| 5,221,506 | 6/1993 | Dulin | 510/144 |
| 5,250,210 | 10/1993 | Von Culin | 510/144 |
| 5,316,689 | 5/1994 | Farrell | 510/144 |

*Primary Examiner*—Christine Skane
*Assistant Examiner*—Necholus Ogden
*Attorney, Agent, or Firm*—Hopgood, Calimafde, Kalil & Judlowe L.L.P.

[57] ABSTRACT

Disclosed is a solid, floating soap which has a formulation density greater than water or a liquid of like density, and which has an overall physical density less than water or a liquid of like density, and a method of making the floating soap.

2 Claims, No Drawings

FLOATING SOAP AND METHOD

FIELD OF THE INVENTION

The present invention relates to solid, buoyant soaps. More specifically, the present disclosure provides a process which makes a soap having a hollow recess, in which is optionally disposed matter which is less dense than water, which allows the resulting product to float in water or a liquid of like density.

BACKGROUND OF THE INVENTION

Currently, the only known way of producing a floating soap is to inject air or a specific gas into a liquid or semi-solid soap mass and allowing solidification. For example, U.S. Pat. Nos. 2,295,594 and 3,835,580 describe the making of IVORY™ soap which is made by whipping air into a liquid soap mass which is poured into molds and allowed to solidify into a buoyant, rectangular or cubic product. The process for making IVORY™ soap is essentially a uniform and homogenous distribution of trapped air bubbles throughout the entire soap block by aeration through purely physical means.

U.S. Pat. No. 3,835,058 also describes the possibility of injecting a "compatible gas" which is not air into a liquid/semi-solid soap mass. Although not disclosed in the '058 patent, gas bubbles such as these could be introduced through a chemical reaction. Several problems are associated with such known floating soaps.

First, the relative low density of these soaps is the result of trapped air dispersed throughout the formed blocks. Such soap blocks do float but have weak consistency and structural matrix, and quickly dissolve away with wet use requiring replacement at a much higher frequency than conventional soap bars. Known processes necessarily require the use of expensive and labor intensive air injection equipment which results in excess expenditure. Such excess costs are passed onto the consumer through the necessity for replacement at higher frequencies relative to conventional solid soaps.

Floating soaps can be novelty items and a need exists in the art for a floating soap with greater emphasis on aesthetics. Gift and decorative soaps are commercially manufactured in a variety of aesthetically pleasing configurations. Known floating soaps cannot be made into such decorative or uniquely shaped bars having sharp edges and fine detail because the only conventional way of obtaining solid floating soaps from the bubbly, liquid precursor is to cast from the liquid/semi-solid state by pouring into molds. A need exists in the art for an extrudeable floating soap having fine detail and sharp edges. The present disclosure describes, inter alia, processes and formulations which provide a floating, decorative soap having fine details.

Accordingly, it is an object of the present invention to provide a solid, floating soap which has a formulation density greater than water or a liquid of like density, and which has an overall physical density less than water or a liquid of like density.

Another object of the present invention is to provide a solid, floating soap of a physical and structural integrity equal to solid conventional soaps which are not buoyant.

A further object of this invention is to provide solid, floating soaps of a physical and structural integrity capable of being shaped into aesthetically pleasing configurations.

Another object of the present invention is to provide a process for making a solid, buoyant soap having a formulation density greater than a liquid having a density substantially similar to water, and which has an overall structural density lighter than that of such a liquid.

It is a further object of this invention to provide a method of making a solid, floating soap having a hollow recess in which is disposed matter which is less dense than water which allows the resulting product to float, and which has physical and structural integrity capable of being shaped into aesthetically pleasing configurations.

These and other objects and advantages are achieved by the invention described below.

SUMMARY OF THE INVENTION

The invention comprises a soap formulation such as, for example, 98.00% soap base, 1.00% fragrance and 1.00% color, which is extruded into a soap billet having a hollow concavity substantially in the volumetric center of the billet. The hollow center may remain empty or filled with a substance having a density lighter than water or a liquid of like density. Floating characteristics are then dependent upon completely sealing off the ends of the billet during pressing.

A suitable soap base used with the present invention is one comprised of about 82.00% sodium tallowate, about 15.00% sodium cocoate, water, fragrance, glycerin, sodium chloride and a selected color. A typical process includes preparing a standard soap bar formulation as noted above, extruding a soap billet with a hollow-making device attached to a plodder worm, implanting a suitable substance into the center of the recess formed to displace air in the center of the billet, and stamping the billet into a novelty shape on a standard soap press.

Suitable substances for implantation into the center of the recess formed in the center of the billet to displace air include any buoyant article such as a plastic toy, a sponge, a hollow rubber ball etc. Such novelties can easily include delightful rewards for children or surprise gift items for adults. Other alternatives include bath oils or buoyant bath salts placed in the hollow space which are used after the soap is cracked, providing both bath oil/salts and a fully functioning bath soap.

Aesthetically pleasing shapes such as a duck or a ship are made using a soap formulation having ingredients such as from about 72% to about 82% sodium soap, wherein said sodium soap is derived from about 75% to about 90% tallow and the remainder is derived from coconut oil; from about 5.0% to about 9.0% glycerin; from about 1.0% to about 3.0% petrolatum; from about 1.0% to about 3.0% a high molecular weight monohydric alcohol; from about 0.1% to about 0.5% coconut fatty acids; and from about 7.0% to about 12.0% by weight water.

Soap derived from tallow is present at a level of about 85% with the remainder derived from coconut oil. This component is listed as a non-limiting example, as other vegetable source oils such as palm oil, palm kernel oil, babassu oil or mixtures there-of can be substituted with similar results.

Other soap ingredients include minor amounts of salts such as sodium chloride or preservatives which are frequently present and can be considered part of the soap. The weight percentage of sodium soap expressed above does not include glycerin because it is considered part of the glycerin ingredient described below.

Glycerin helps processability of the final formula, but other ingredients such as isopropyl palmitate or isopropyl myristate will achieve similar results. Suitable alternatives to the high molecular weight monohydric alcohol include saturated or unsaturated alcohols of fatty acids or their mixtures, such as those having between 14 to 22 carbons (myristoyl to behenolyl alcohols) with between 3 to 10 moles of propylene oxide and 20 to 50 moles of ethylene oxide. The high molecular weight monohydric alcohol As for the water content, if the upper limit of about 12.0% is exceeded, the composition can become sticky and soft, affecting processability. Maintaining at least 8.0% water is important for migration of the composition through extrusion equipment. In the embodiment expressed above, the primary function of the coconut fatty acid is to neutralize the free alkalinity of the soap base.

The high molecular weight monohydric alcohol can be eliminated if greater amounts of coconut fatty acids are added. Soap bars within the scope of this embodiment include those which have from about 72% to about 82% sodium soap, wherein said sodium soap derived from about 7.5% to about 90% tallow and the remainder derived from coconut oil; from about 5.0% to about 9.0% glycerin; from about 1.0% to about 3.0% petrolatum; from about 1.0% to about 5.0% coconut fatty acids; and from about 7.0% to about 12.0% water.

The present soap compositions can be colored without detracting from their properties. While many soap bars are white, color is often desirable to further enhance the aesthetic value of the product. This is accomplished by the adding of minor amounts of colorants. These amounts and colorants are well-known in the soap making art. The same is applicable for fragrances which are added without detracting from the floating properties. Minor amounts of fragrances, also well-known in the soap making art, are added to enhance the product.

DETAILED DESCRIPTION OF THE INVENTION

The soap bars of this invention are readily prepared by using conventional soap-making equipment. For example, a preferred method is to produce sodium soap in a Mazzoni "SC" plant. The resulting neat soap (approximately 32% moisture) is then transferred to a holding tank. Appropriate amounts for the sodium soap are disclosed in this specification.

The resulting combination is dried in a Mazzoni spray dryer and the water level is adjusted to desired proportions. Storage hoppers collect the composition in the form of noodles. This base product is then added to an amalgamator, where colorants and perfume are admixed. The resulting combination is converted to a homogeneous composition by extruding through two Mazzoni simplex plodders fitted with screens (0.1 mm to 3.0 mm). A Mazzoni duplex plodder then extrudes the composition under vacuum while creating a series of individual holes compartmentalized in the center line of the exrudate by using a hollow maker attached to the plodder.

The resulting intermediate product is cut into billets with each billet having a hollow center compartmentalized in it. The billets are then stamped into the desired novelty configuration on a Mazzoni STO-C press using an appropriately shaped die. Those skilled in the art could adapt the above procedure to obtain the floating soap of the present invention. These adaptations are within the scope and spirit of the present disclosure.

For example, the series of individual hollow centers compartmentalized in the exrudate are left empty and individually sealed off as the ends of the billets are sealed in the soap press. The seal is of a nature such as to create an air-tight, pneumatically sealed enclosure filled with trapped air which provides buoyancy in this case. The unique shapes to be stamped in the Mazzoni STO-C press are selected for their ability to withstand collapse of the center cavity while sealing.

In another embodiment, a water soluble starch insert was placed in the hollow spaces to displace the trapped air before sealing and pressing. The starch is able to give the pressed billet sufficient structural integrity to withstand pressing into unique and detailed shapes. Alternatively, any substance having a density lighter than water or a liquid of like density can be inserted for similar results.

EXAMPLE 1

Preparation of Floating Soap

Solid soaps of various sizes and shapes were made according to the present invention to test their ability to float in water.

A homogeneous sodium soap composition, having a soap base of approximately 82% sodium tallowate and 15% sodium cocoate as disclosed in this specification, was extruded through two Mazzoni simplex plodders fitted with screens (0.1 mm to 3.0 mm). Using a Mazzoni duplex plodder with a hollow maker, an elongated intermediate product in the shape of a log with a continous hollow center was extruded under vacuum. The temperature was maintained at about 95° F. to about 115° F.

The intermediate, hollow log was cut into billets approximately 4.0" long by 2.5" wide, with each billet having a hollow center approximately 1.5" wide in diameter. Each billet was then stamped using a 5 oz. die in the shape of an egg on a hand press while simultaneously sealing off the two open ends. The 1.5" hole proved too big for the die shape and the wall collapsed.

Another intermediate, hollow log was extruded with a 1.0" diameter hollow center and cut into billets approximately 4.0" long by 2.5" wide, with each billet having a hollow center approximately 4.0" long by 1.0" wide. Each billet was then stamped using a 5 oz. die in the shape of an egg on a hand press which sealed off the two ends. The resulting hollow egg was able to float in water.

A hollow log was again extruded and cut into billets approximately 4.0" long by 2.5" wide, with each billet having a hollow center approximately 1.0" wide. The billets were then stamped using a 5 oz. die in the shape of a football in a Mazzoni STO-C Press. The resulting football-shaped bar with tapering, sealed ends was able to float well in water. Upon dissection, it was found that the center of the soap had expanded from the 10" pre-stamp diameter to 1.125" midline diameter.

EXAMPLE 2

Floating Soap with Starch Insert

A homogeneous sodium soap composition was extruded into a cylindrical log having a continuous, 1.0" diameter hollow center. The hollow log was cut into billets approximately 4.0" long by 2.5" wide, with each billet having a hollow center approximately 1.0" wide. One solid, corn starch pellet approximately 1.0" long and about 0.5" wide was placed in each billet to help evacuate air from the billet before pressing. The corn starch pellet used was ECO-FOAM™, National Starch & Chemical Co., Bridgewater, N.J. Such pellets are environmentally safe as they readily dissolve in water and drains away when the soap enclosing it is used up.

Each billet containing a single starch pellet was then stamped using a 5 oz. die in the shape of a football in a Mazzoni STO-C Press. The procedure was repeated using two corn-starch pellets. The resulting football-shaped bars floated well in water.

Various modifications and alterations to the presently disclosed method man be appreciated based on a review of this disclosure. For instance, equipment made by Mazzoni, well known in this art, can be readily substituted for other like equipment. Such changes and additions are intended to be within the scope and spirit of this invention as defined by the following claims.

What is claimed is:

1. A process for making a floating soap, comprising the following steps:

(a) preparing a solid soap formulation;

(b) extruding a soap billet from said solid soap formulation with an extruder having a hollow-making means such that a hollow recess is formed within said billet; and (c) stamping said billet such that said hollow recess is pneumatically sealed off; and (d) implanting a select substance to displace the air or gas in said recess, said substance has a density less than that of water, and being a water-soluble starch.

2. The process for making a floating soap of claim 1, wherein said step of stamping said billet such that said hollow recess is pneumatically sealed off includes stamping said billet into a selected aesthetically pleasing configuration.

* * * * *